US006704536B2

(12) United States Patent
Nakayama

(10) Patent No.: US 6,704,536 B2
(45) Date of Patent: Mar. 9, 2004

(54) FIXING APPARATUS

(75) Inventor: Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/238,691

(22) Filed: Sep. 11, 2002

(65) Prior Publication Data

US 2003/0063932 A1 Apr. 3, 2003

(30) Foreign Application Priority Data

Sep. 11, 2001 (JP) ..... 2001-274481

(51) Int. Cl.[7] ..... G03G 15/20

(52) U.S. Cl. ..... 399/328; 219/216; 219/619; 399/330

(58) Field of Search ..... 399/328, 329, 399/330, 333, 320; 219/216, 469, 619; 347/156

(56) References Cited

U.S. PATENT DOCUMENTS

| | | | | |
|---|---|---|---|---|
| 4,712,908 A | | 12/1987 | Nakayama et al. | 399/86 |
| 5,530,556 A | | 6/1996 | Miura et al. | 358/300 |
| 6,262,404 B1 | * | 7/2001 | Higaya et al. | 219/619 |
| 6,377,775 B1 | | 4/2002 | Nakayama et al. | 399/328 |
| 6,456,818 B1 | | 9/2002 | Nakayama et al. | 399/328 |
| 2001/0022299 A1 | * | 9/2001 | Takagi et al. | 219/619 |

FOREIGN PATENT DOCUMENTS

| | | | |
|---|---|---|---|
| JP | 51-109736 | | 9/1976 |
| JP | 54-39645 | | 3/1979 |
| JP | 09-197850 | * | 7/1997 |
| JP | 09-305043 | * | 11/1997 |
| JP | 2001-230065 | * | 8/2001 |

* cited by examiner

*Primary Examiner*—Sophia S. Chen
(74) *Attorney, Agent, or Firm*—Fitzpatrick, Cella, Harper & Scinto

(57) ABSTRACT

An image fixing apparatus includes a coil for generating a magnetic field; a heating medium, accommodating the coil therein, for generating heat by induction of eddy current by the magnetic field generated by the coil, wherein the heat of the heating medium is usable to heat an image on a recording material; a non-magnetic member provided between a heat generating portion of the heating medium and the coil with a gap relative to the heating medium, wherein the coil is in close contact to the non-magnetic member, and such a portion of the non-magnetic member as is in close contact to the coil extends to outside of the heating medium.

14 Claims, 5 Drawing Sheets

FIXING APPARATUS

FIELD OF THE INVENTION AND RELATED ART

The present invention relates to a fixing apparatus which fixes the toner image on transfer medium by welding the toner image on recording medium to the recording medium.

Usually, an eloctrophotographic image forming apparatus is equipped with a fixing apparatus comprising a heating means (roller, endless belt, etc.) and a pressing means (roller, endless belt, etc.). The heating and pressing means of the fixing apparatus are rotationally driven while being kept pressed upon each other, and while transfer medium, to which toner composed of resinous substance, magnetic substance, coloring agent, etc is held, is conveyed through the contact area (nipping portion) between the heating and pressing means, remaining nipped by the heating and pressing means, heat and pressure are applied to the transfer medium from the heating and pressing means. As a result, the toner is welded (fixed) to the transfer medium Regarding a fixing apparatus such as the one described above, Japanese Laid-Open U.M. Application 51-109736 disclose a heat generating method which uses the Joule effect. According to this method, the heating means comprises an excitation coil, and an electrically conductive layer (which hereinafter will be simply referred to an conductive layer) on the inward surface of the fixing roller head, and heat is generated as eddy current is induced in the conductive layer by the excitation coil. This method is characterized in that it makes it possible to place a heat generating source very close to toner, being therefore capable of substantially reducing the time it takes for the fixing roller surface temperature to reach the proper temperature for fixation when starting up the fixing apparatus, compared to a conventional heat roller type heating method which employs a halogen lamp. Further, it is also characterized in that it is shorter and simpler in the heat transmission path from the heat generating source to the toner, being therefor higher in thermal efficiency.

In a fixing apparatus employing an electromagnetic induction based heating method, a strong magnetic field cannot be obtained unless the distance between the excitation coil and the electrically conductive layer on the internal surface of the fixing roller is made as small as possible. Therefore, the excitation coil must be placed as close as possible to the fixing roller without allowing the excitation coil to come into contact with the fixing roller while the fixing roller is rotating. Also, the fixing roller of a fixing apparatus must be enabled to maintain its temperature at a level necessary to fix the toner on the recording medium. Thus, the excitation coil is positioned close to the fixing roller in a manner to oppose the fixing roller. Therefore, the temperature of the excitation coil increases as the temperature of the fixing roller increases. As the excitation coil increases in temperature, its electrical resistance increases, reducing the current which is allowed to flow through it, which in turn reduces the heat it generates. In other words, as the excitation coil is heated, it declines in its heat generation efficiency, which is a problem. Further, usually, the excitation coil is disposed within a coil unit which comprises the excitation coil and the member for supporting the excitation coil. Therefore, it is difficult for the heat from the excitation coil to directly dissipate into the ambience. Thus, in order to provide a reliable fixing apparatus, it is necessary to solve this problem, that is, the increase in the excitation coil temperature. As for the countermeasure therefor, it is possible to place a piece of non-magnetic substance, such as a resinous member, in contact with the excitation coil in order to transfer the heat of the excitation coil to the piece of non-magnetic substance. However, when the distance between the coil unit and fixing roller is small, the coil unit is affected by the heat from the fixing roller, preventing sometimes the heat from the excitation coil from being dissipated. Thus, an efficient method for dissipating heat from the coil unit has been desired.

As for the methods for preventing the increase in the excitation coil temperature, there has been devised a method which employs a heat transferring member formed of efficient heat conductor such as aluminum, copper, or the like, to outwardly transfer the heat from the fixing roller, a method which employs a cooling fan to air cool the excitation coil, and the like method. In the case of the method which employs the cooling fan, air passages are provided within the excitation coil unit as disclosed in Japanese Laid-Open Patent Application No. 54-39645.

The internal positioning of a heat transferring member formed of efficient heat conductor such as aluminum, copper, or the like, however, increases the overall thermal capacity of the internal members of the fixing roller. As a result, not only does the start-up time increases, but also the electrical power necessary for the satisfactory fixation. A method employing a cooling fan also suffers from these problems. Therefore, there is demand for a structural arrangement which prevents the increase in the excitation coil temperature without increasing the electrical power necessary for the satisfactory fixation.

SUMMARY OF THE INVENTION

The primary object of the present invention is to provide a fixing apparatus in which the temperature of the excitation coil does not increases and the electrical power necessary for fixation is minimized, and also to provide an image forming apparatus comprising such a fixing apparatus According to one of the characteristic aspects of the present invention, a fixing apparatus, or an image forming apparatus, comprises: a coil for generating a magnetic field; a heating medium in which heat is generated as eddy current is induced therein by the magnetic field generated by the coil, and which thermally fixes the image on recording medium with the use of the generated heat; a non-magnetic member disposed between the heat generating portion of the heating medium and the coil, with the provision of a predetermined gap from the heating medium, the coil being placed in contact with the nonmagnetic member, and the portion of the non-magnetic member in contact with the coil extending outward of the heating medium.

According to another characteristic aspects of the present invention, a fixing apparatus or an image forming apparatus, comprises: a coil for generating a magnetic field; a fixing roller in which heat is generated as eddy current is induced therein by the magnetic field generated by the coil, and which fixes the unfixed toner image on recording medium with the use of the generated heat; a non-magnetic member disposed between the heat generating portion of the heating medium and the coil, with the provision of a predetermined gap from the heating medium, the coil being placed in contact with the non-magnetic member, and the portion of the nonmagnetic member in contact with the coil extending outward of the heating medium.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First, referring to FIG. 1, the sequential image formation processes will be described.

Figure 1:
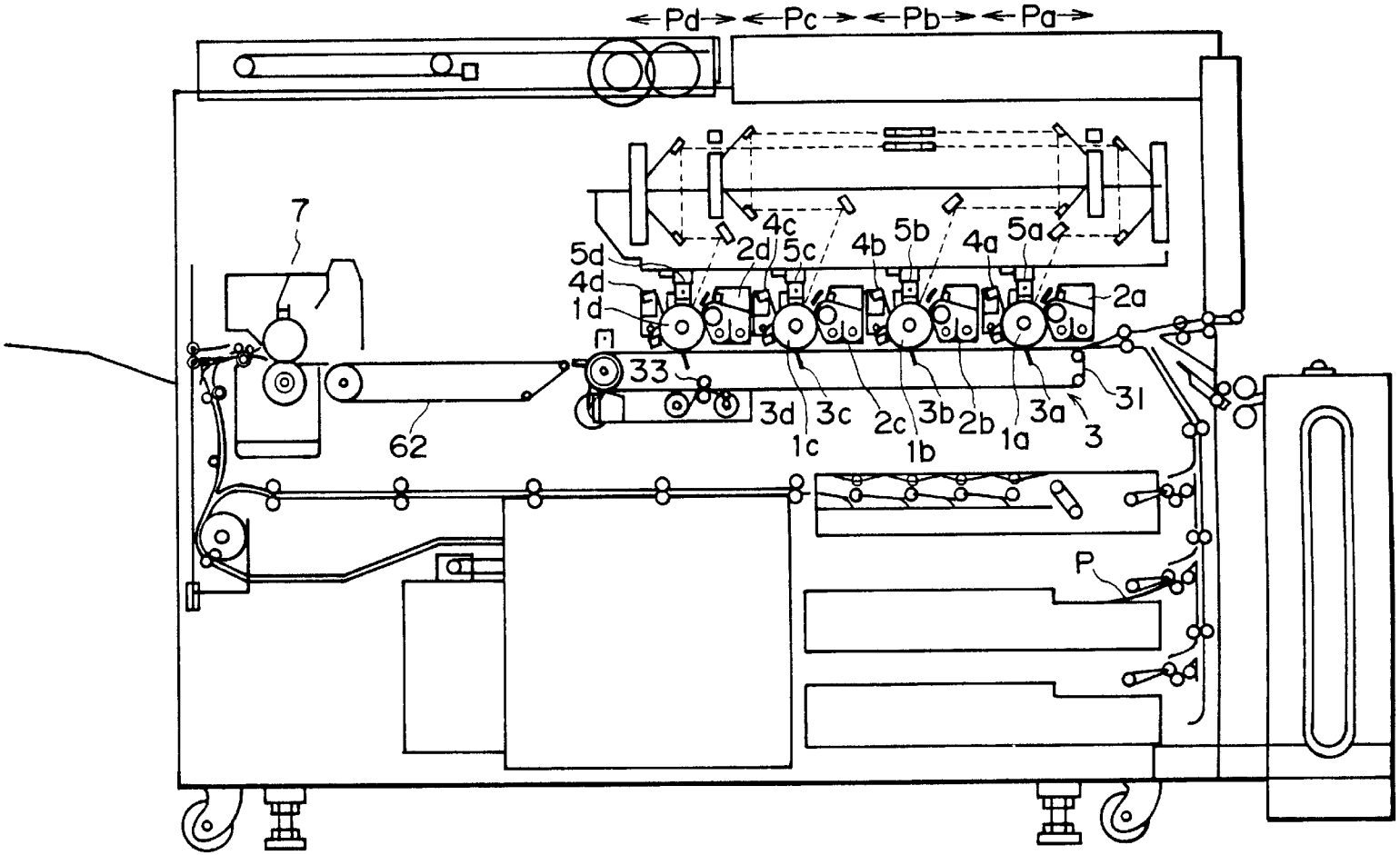
FIG. 1 is a sectional drawing for showing the general structure of an image forming apparatus.

FIG. 1 is a schematic sectional view of a laser beam printer (which hereinafter will be referred to as printer), as an example of an image forming apparatus in accordance with the present invention, which comprises four photoconductive drums and a plurality of optical scanning means. It shows the general structure of the printer.

Referring to FIG. 1, the printer in this embodiment comprises four image formation stations as image forming means. Each image forming station comprises: an electrophotographic photosensitive member (which hereinafter will be referred to as "photoconductive drum") as a latent image bearing member, and a plurality of image processing apparatuses, such as a developing apparatus, disposed around the photoconductive drum. The image formed on the peripheral surface of the photoconductive drum by each image formation station is transferred onto recording medium (which hereinafter will be simply referred to as paper), such as paper, on a conveying means which is moved virtually in contact with the peripheral surface of the photoconductive drum.

The four image formation stations Pa, Pb, Pc and Pd form images corresponding to the magenta, cyan, yellow and black color components, respectively. They comprise photoconductive drums 1*a,* 1*b,* 1*c* and 1*d,* respectively, and are rotationally driven in the direction indicated by an arrow mark. Around the photoconductive drum 1*a,* 1*b,* 1*c* and 1*d,* charging apparatuses 5*a,* 5*b,* 5*c* and 5*d* for charging the peripheral surfaces of the photoconductive drums 1*a,* 1*b,* 1*c* and 1*d,* respectively, developing apparatuses 2*a,* 2*b,* 2*c* and 2*d* for developing image formation information after the charging and exposing processes, cleaning apparatuses 4*a,* 4*b,* 4*c* and 4*d* for removing the toner particles remaining on the photoconductive drum after the image transfer, are disposed in the listed order in terms of the rotation direction of the photoconductive drum. Located on the downstream sides of the photoconductive drums 1*a,* 1*b,* 1*c* and 1*d,* are transfer stations 3, which share a transfer belt 31 as a recording medium conveying means and comprise transfer charging devices 3*a,* 3*b,* 3*c* and 3*d,* respectively.

In the above described printer, color images corresponding to the aforementioned color components are formed on the peripheral surfaces of the four photoconductive drums, one for one, and the paper P supplied from the sheet feeder cassette, as a recording medium supplying means, shown in FIG. 1, is conveyed by the transfer belt 31, being supported by the transfer belt 31, to each of the image forming stations. In each image forming station, the color toner image on the photoconductive drum is transferred onto the paper P. As a result, four toner images different in color are placed in layers on the paper P. After this transferring process, the paper P is separated from the transfer belt 31 and is conveyed to a fixing apparatus 7 by a conveyer belt 62 as a recording medium guiding means.

Figure 2:
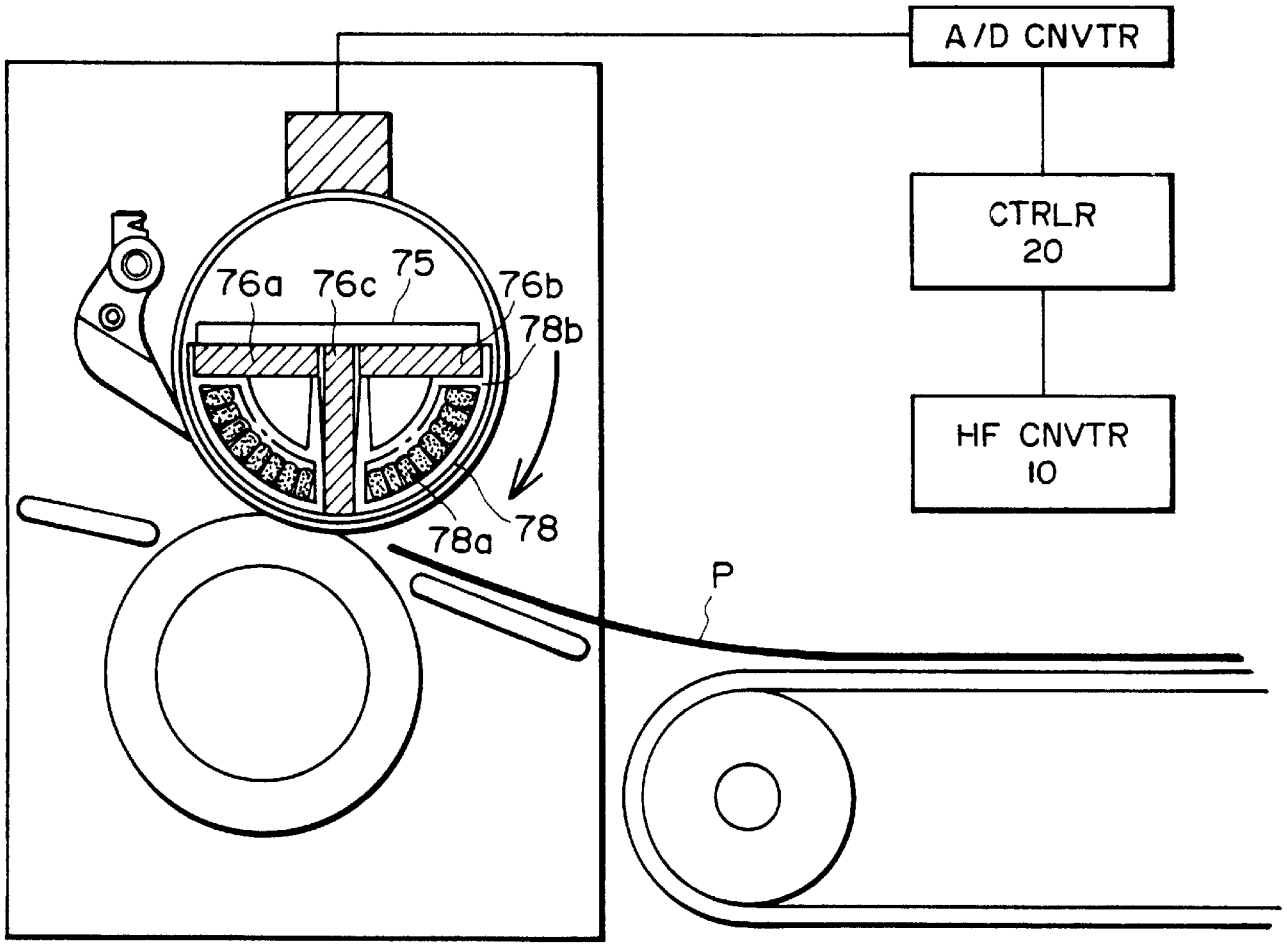
FIG. 2 is a sectional drawing for showing the general structure of a fixing apparatus.

Next, the fixing apparatus 7 will be described. FIG. 2 is a sectional view of the fixing apparatus 7, which is a typical embodiment of the present invention. The fixing roller 71 as a fixing member comprises a metallic cylinder, which is 32 mm in external diameter and 0.7 mm in thickness, and a 10–50 $\mu$m thick layer of PTFE or PFA, for example, coated on the peripheral surface of the metallic cylinder to enhance the releasing property of the fixing roller 71. As for the material for the fixing roller 71, a magnetic substance (magnetic metal) such as magnetic stainless steel, which is relatively high in permeability and is proper in electrical resistance, may be used. A nonmagnetic substance such as an electrical conductive metal can also be used. In such a case, the nonmagnetic substance should be in the form of thin film or the like.

The pressure roller 72 as a pressing member comprises an iron core with an external diameter of 20 mm, a 5 mm thick layer of silicon rubber coated on the peripheral surface of the iron core, and a 10–50 $\mu$m thick layer of PTFE or PFA, for example, coated on the peripheral surface of the silicon rubber layer to enhance the releasing property of the fixing roller 71. Thus, the external diameter of the pressure roller 72 is 30 mm.

The fixing roller 71 and pressure roller 72 are rotationally supported, and the fixing roller 71 is rotationally driven. The pressure roller 72 is kept pressed on the peripheral surface of the fixing roller 71, forming a compression nip (nipping portion), by the pressure generated in the direction of the rotational axis of the fixing roller 71 by an unshown mechanism comprising springs, or the like, and is rotated by the friction between the two rollers.

The surface temperature of the fixing roller 71 is automatically kept constant at a predetermined level. More specifically, the temperature sensor 73 as a temperature detecting member is placed in contact with the peripheral surface of the fixing roller 71. The temperature signals detected in the form of voltage by the temperature sensor 73 are converted into digital signals and are inputted into the controller portion 20, which increases or decreases the electrical power supply to the excitation coil 78*a* in response to the inputted digital signals, so that the surface temperature of the fixing roller 71 is kept constant at the predetermined level.

Next, the excitation coil unit 78 as a coil unit will be described in more detail.

Figure 3:
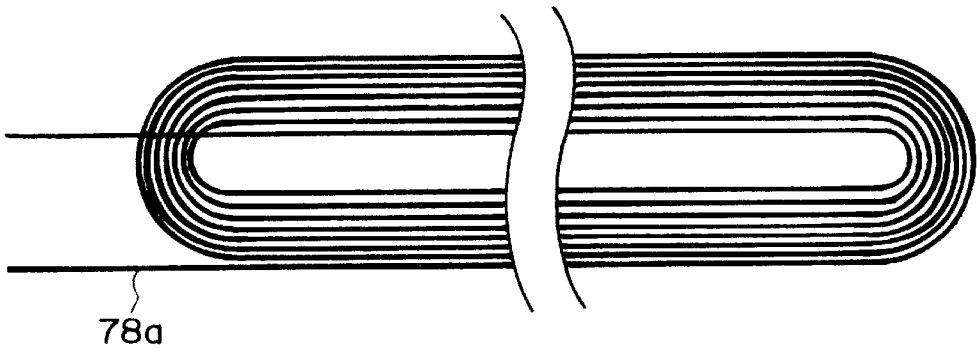
FIG. 3 is a schematic drawing of the coiled wire of an excitation coil.
Figure 4:
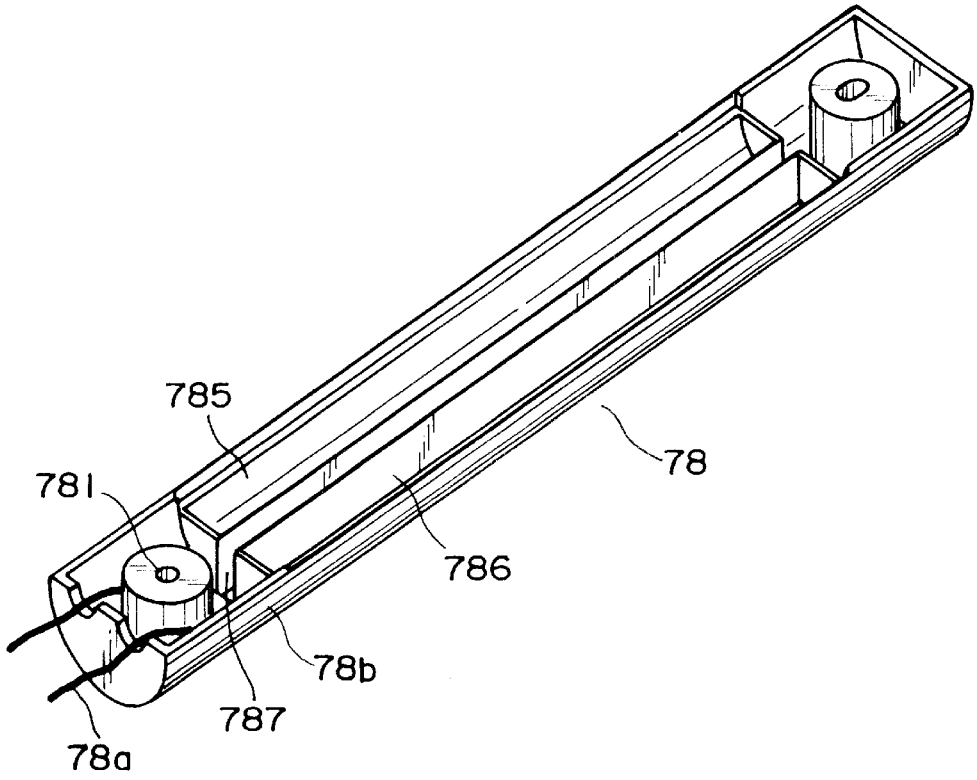
FIG. 4 is a perspective view of an excitation coil unit.
Figure 5:
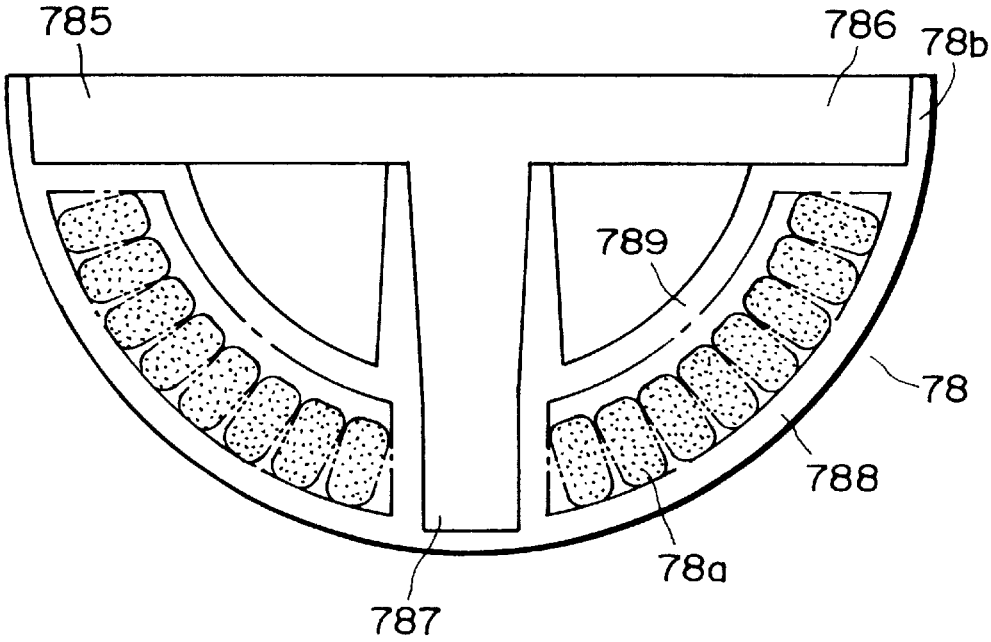
FIG. 5 is a sectional view of the excitation coil unit.
Figure 6:
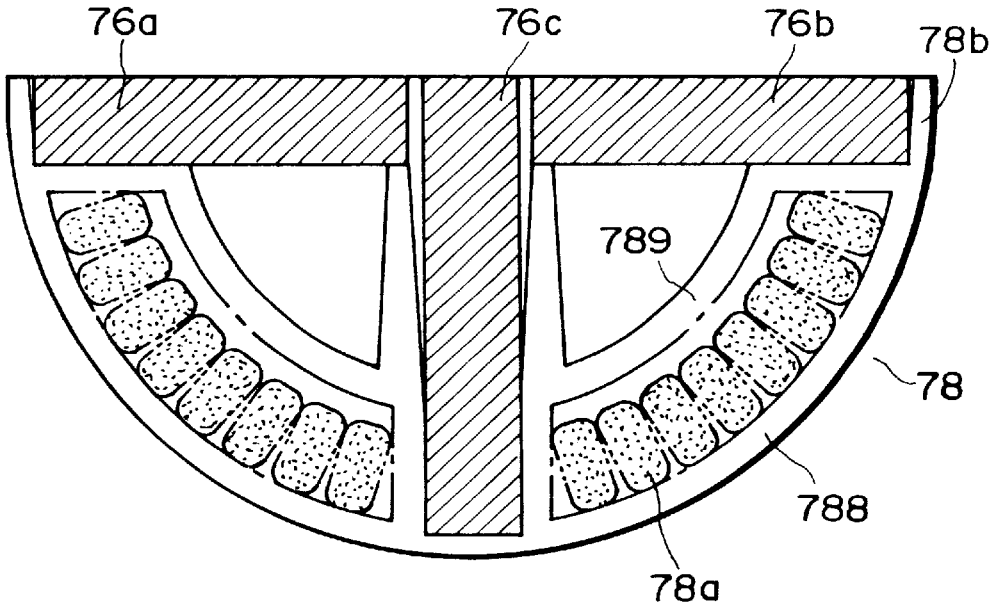
FIG. 6 is a sectional view of an excitation coil unit with a magnetic core.

The excitation coil 78*a* is connected to the high frequency converter 10, and is supplied with 100–2000 kW of high frequency electrical power. Therefore, the excitation coil 78*a* is formed of a Litz wire, that is, a wire composed of a number of insulated strands woven together to reduce skin effect. More specifically, it comprises a Litz wire wound as shown in FIG. 3, and a resinous supporting member, as a supporting member, into which the Litz wire has been molded. As the resinous material for the excitation coil 78*a,* a nonmagnetic resinous substance, for example, PPS, PBT, PET, LCP (liquid polymer), etc., are available. FIGS. 4 and 5 are perspective and sectional views, respectively, of the excitation coil unit 78 integrally comprising the excitation coil 78*a*. The resinous portion 78*b* of the coil unit 78 doubles as the holder for holding the magnetic cores 76 (76*a,* 76*b* and 76*c*) to the positions 785, 786 and 787, respectively (FIG. 6).

As the material for the magnetic core 76, a substance, such as ferrite, which is high in permeability and is small in loss, is used. When a metallic alloy such as Permalloy is used as the material for the magnetic core 76, the eddy current loss caused within the core by high frequency is greater than otherwise, and therefore, the magnetic core 76 may be given a laminar structure. The magnetic core 76 is employed to increase the magnetic circuit efficiency and also, to block the magnetism. The coil unit 78 is attached to a stay 75, being thereby stationarily disposed relative to the fixing apparatus.

Next, the structure of the coil unit 78 in this embodiment, which integrally comprises the excitation coil 78*a,* will be described. The coil unit 78 comprises supporting members 788 and 789, as excitation coil supporting the members, which support the excitation coil 78*a* from the inward and outward sides, respectively, of the excitation coil 78*a*. The supporting member 788 is integral with the coil unit. When assembling the coil unit 78, first, the excitation coil is attached to the inward surface of the first supporting member 788, and then, the second supporting member 789 is placed in contact with the other side of the coil. Next, resin in the liquid state is poured into the gaps between the first and second supporting members, and is cooled. As a result, the coil unit 78 integrally comprising the excitation coil 78*a* is obtained. Although the coil unit 78 in this embodiment is integral in structure with the excitation coil 78*a,* the structure of the coil unit 78 does not need to be integral with that of the excitation coil 78*a;* a molding method other than the one used in this embodiment may be employed as long as the resulting structure is such that the virtually the entirety of the surface area of the excitation coil can be kept in contact with the supporting members.

Figure 7:
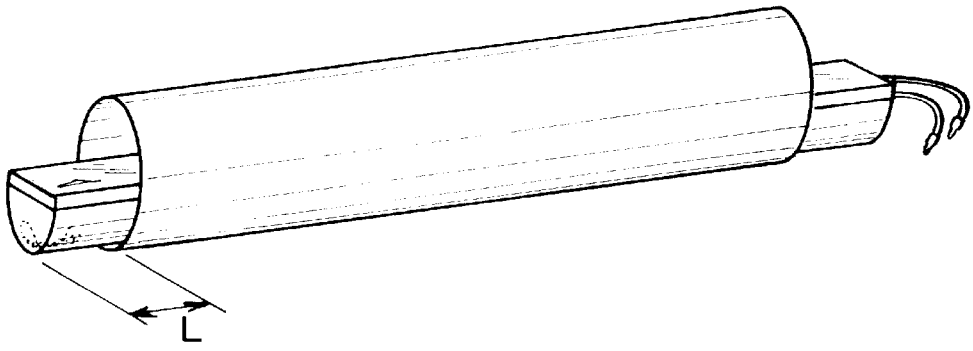
FIG. 7 is a perspective drawing for showing the positional relationship between the excitation coil and fixing roller.

The coil unit 78 is made longer than the fixing roller 71, and is disposed so that its lengthwise end portions are exposed from the corresponding lengthwise ends of the fixing roller 71 (FIG. 7). Referring to FIGS. 4 and 7, the coil unit 78 is structured so that not only does the first supporting member 788 for supporting the excitation coil 78*a* extend through the excitation coil 78*a*, but also it reaches both lengthwise ends of the coil unit 78. The heat from the excitation coil 78*a* conducts through the resinous portion and/or coil supporting members of the coil unit 78, and dissipates into the ambience from the lengthwise ends of the coil unit 78 exposed from the lengthwise ends of the fixing roller 71. Therefore, the length L by which the coil unit 78 is exposed from each lengthwise end of the fixing roller 71 is desired to be no less than 5 mm. The greater the length by which the coil unit 78 is exposed, the smaller the effect of the heat from the fixing roller. In this embodiment, the length L was 25 mm.

Figure 8:
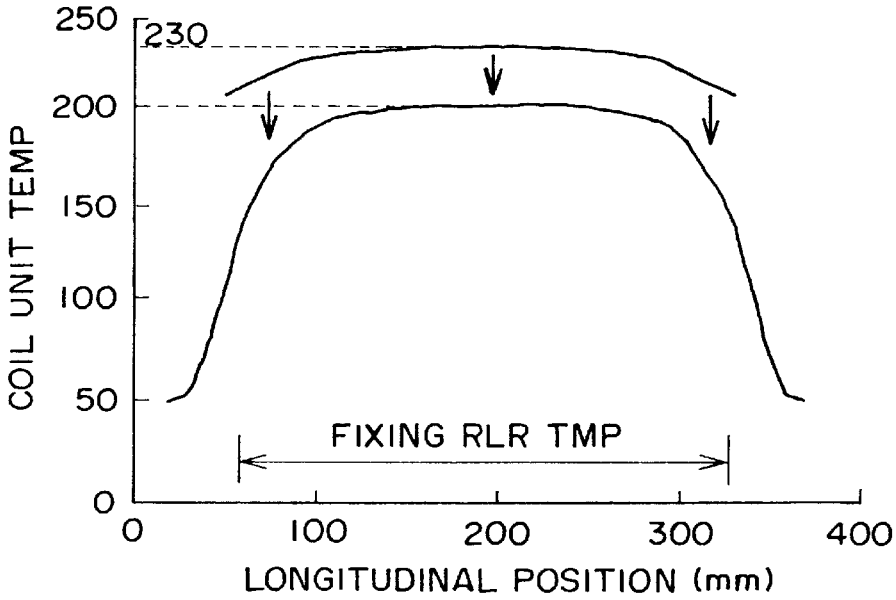
FIG. 8 is a graph for showing the effect of the exposure of the lengthwise end portions of the resinous portion of the excitation coil unit from the corresponding lengthwise ends of the fixing roller.

FIG. 8 shows the temperature distributions of a coil unit (78), the lengthwise end portions of the resinous unit of which are exposed from the fixing roller 71, and a coil unit (78), the lengthwise end portions of the resinous unit of which are not exposed from the fixing roller 71. The temperature distribution without the exposure of the resinous units from either of the lengthwise ends of the coil unit 78 was as represented by the curved line A in the graph. With the exposure of the resinous units from both of the lengthwise ends of the fixing roller, the temperature distribution of the coil unit 78 was improved to the one represented by the curved line B in the graph. As is evident from the graph, in the case of the coil unit (78), the resinous unit of which was not exposed at either of its lengthwise ends, its temperature reached as high as 230° C., whereas in the case of the coil unit (78), the resinous unit of which was exposed by 25 mm at both of its lengthwise ends, its highest temperature was 200° C. The relationship between the length by which the end portion of the coil unit was exposed and the highest temperature to which the coil unit 78 reached is shown by Table 1 given below.

TABLE 1

| Exp. Amount (mm) | Max. Temp. (° C.) |
|---|---|
| 0 | 230 |
| 3 | 221 |
| 5 | 215 |
| 10 | 210 |
| 15 | 205 |
| 20 | 203 |
| 25 | 200 |
| 30 | 198 |
| 35 | 197 |
| 40 | 196 |

According to the present invention, each wire of the excitation coil of a fixing device is coated with electrically insulative film. As the thickness of the insulative film is increased to ensure the insulation, the distances between some wires and the fixing member increase, reducing the heat generation efficiency. Therefore, the thickness of the insulative film must be reduced as much as possible. On the other hand, the coil should be disposed as close as possible to the fixing member. Therefore, the insulative film must be heat resistant enough to withstand a temperature level close to that of the fixation temperature. In other words, in order for the insulating film to be used for the embodiment of the present invention, it must be satisfactory in thickness as well as heat resistance. However, the need for decreasing the thickness of the insulative film limits the insulative film in terms of heat resistance. In consideration of the above described degree of heat resistance, polyimide, polyamide-imide, or the like, is used as the material for the insulative film. Although the thickness of the insulative film is desired to be in the range of 5–50 $\mu$m, the thinner the insulative film, the higher the heat generation efficiency. In order to ensure that the insulative film remains intact against the heat from the excitation coil and/or coil unit, the temperature of the excitation coil and/or coil unit must be kept no higher than 220° C. Thus, the length by which the coil unit is exposed must be no less than 5 mm.

As described above, the excitation coil 78*a* is placed in contact with the nonmagnetic portion (resinous portion) of the coil unit 78, its distance from the metallic core (conductive layer) of the fixing roller remains stable, being enabled to efficiently generate heat. Also as described above, as the temperature of the excitation coil increases, it becomes more difficult for electrical current to flow through the excitation coil. In other words, the increase in the excitation coil temperature reduces the electrical power source efficiency. According to this embodiment, however, the virtually the entirety of the surface area of the excitation coil 78*a* is in contact with the nonmagnetic substance (resinous substance) instead of air. Therefore, heat is highly efficiently transferred away from the excitation coil 78*a*, preventing the excitation coil and magnetic core 78 from increasing in temperature. Incidentally, as the temperature of the magnetic core increases beyond the Curie point, the permeability of the magnetic core suddenly decreases, reducing suddenly the heat generation efficiency. Therefore, the temperature of the magnetic core is desired to kept below the Curie point.

Further, the resinous unit as the nonmagnetic member is exposed from both lengthwise ends of the fixing roller 71, making it possible for the heat of the coil to efficiently radiate.

Further, the coil unit 78, which integrally comprises the excitation coil, doubles as the holder for magnetic core 76. Therefore, the apparatus can be made compact, and also, the excitation coil and magnetic core can be kept more accurately positioned relative to each other, improving heat generation efficiency.

In the preceding embodiment of the present invention, the fixing member of the fixing apparatus was in the form of a roller. However, a nickel-plated belt, or the like produced using electrical plating, may be employed instead of the fixing roller.

As described above, according to the present invention, which relates to a fixing apparatus employing an electromagnetic induction type heating method, that is, a method in which heat is generated by the eddy current generated in the electrically conductive layer of the heating means by the excitation coil, the lengthwise end portions of the coil unit of the fixing apparatus are exposed from the fixing member. Therefore, the heat of the coil is allowed to escape from the lengthwise ends of the coil unit after conducting through the coil unit. As a result, the excitation coil is prevented from increasing in temperature, and therefore, the heat generation efficiency of the excitation coil is prevented from declining. In other words, the present invention makes it possible to provide a fixing apparatus, the heat generation efficiency of much better than that of a fixing apparatus in accordance with the prior arts.

These and other objects, features and advantages of the present invention will become more apparent upon a consideration of the following description of the preferred embodiments of the present invention taken in conjunction with the accompanying drawings

What is claimed is:

1. An image fixing apparatus comprising:

a coil for generating a magnetic field;

a heating medium, accommodating said coil therein, for generating heat by induction of eddy current by the magnetic field generated by said coil, wherein the heat of said heating medium is usable to heat an image on a recording material;

a non-magnetic member provided between a heat generating portion of said heating medium and said coil with a gap relative to said heating medium, wherein said coil is in close contact to said non-magnetic member, and such a portion of said non-magnetic member as is in close contact to said coil extends to outside of said heating medium.

2. An apparatus according to claim 1, wherein said coil is surrounded by said non-magnetic member.

3. An apparatus according to claim 1, wherein said non-magnetic member is made of resin material.

4. An apparatus according to claim 1, wherein said non-magnetic member extends outwardly beyond an end of said heating medium by at least 5 mm.

5. An apparatus according to claim 1, wherein a dimension of the extension of said non-magnetic member measured in a direction perpendicular to a feeding direction of the recording material is larger than a dimension of said heating medium measured in a direction perpendicular to the feeding direction.

6. An apparatus according to claim 1, further comprising a pressing member forming a nip for nipping, pressing and feeding the recording material.

7. An apparatus according to claim 1, wherein said image fixing apparatus is usable with an image forming apparatus including an image bearing member for bearing an electrostatic image, a developing device for supplying toner to the electrostatic image; and a transfer device for transferring the toner from said image bearing member onto the recording material.

8. An image fixing apparatus comprising:

a coil for generating a magnetic field;

a fixing roller for fixing an unfixed toner image on a recording material by heat generated by eddy current caused by a magnetic field generated by said coil;

a non-magnetic member provided between a heat generating portion of said fixing roller and said coil with a gap relative to said fixing roller, wherein said coil is in close contact to said non-magnetic member, and such a portion of said non-magnetic member as is in close contact to said coil extends to outside of said fixing roller.

9. An apparatus according to claim 8, wherein said coil is surrounded by said non-magnetic member.

10. An apparatus according to claim 9, wherein said non-magnetic member is made of resin material.

11. An apparatus according to claim 8, wherein said non-magnetic member extends outwardly beyond an end of said fixing roller by at least 5 mm.

12. An apparatus according to claim 8, wherein a dimension of the extension of said non-magnetic member measured in a direction perpendicular to a feeding direction of the recording material is larger than a dimension of said fixing roller measured in a direction perpendicular to the feeding direction.

13. An apparatus according to claim 8, further comprising a pressing member forming a nip for nipping, pressing and feeding the recording material.

14. An apparatus according to claim 8, wherein said image fixing apparatus is usable with an image forming apparatus including an image bearing member for bearing an electrostatic image, a developing device for supplying toner to the electrostatic image; and a transfer device for transferring the toner from said image bearing member onto the recording material.

* * * * *

UNITED STATES PATENT AND TRADEMARK OFFICE

CERTIFICATE OF CORRECTION

PATENT NO. : 6,704,536 B2
DATED : March 9, 2004
INVENTOR(S) : Toshinori Nakayama It is certified that error appears in the above-identified patent and that said Letters Patent is hereby corrected as shown below:

Column 4,
Lines 32 and 34, “silicon” should read -- silicone --.

Column 6,
Line 66, “the” (1st occurrence) should be deleted.

Column 7,
Line 8, “desired to” should read -- preferred to be --.

Signed and Sealed this

Sixth Day of July, 2004

JON W. DUDAS
*Acting Director of the United States Patent and Trademark Office*